US008026433B2

(12) United States Patent
Place et al.

(10) Patent No.: US 8,026,433 B2
(45) Date of Patent: Sep. 27, 2011

(54) APPARATUS FOR USING A PERSON'S HIPS TO CARRY THE LOAD OF MARCHING PERCUSSION EQUIPMENT OR OTHER OBJECTS WHICH ARE CARRIED NEAR WAIST-HEIGHT AND IN FRONT OF A PERSON

(76) Inventors: Ned Allen Place, Arlington, TX (US); Mikel Rust Shelton, Arlington, TX (US)

( * ) Notice: Subject to any disclaimer, the term of this patent is extended or adjusted under 35 U.S.C. 154(b) by 0 days.

(21) Appl. No.: 12/655,772

(22) Filed: Jan. 7, 2010

(65) Prior Publication Data

US 2011/0162509 A1 Jul. 7, 2011

(51) Int. Cl.
*G10D 13/02* (2006.01)

(52) U.S. Cl. ..... 84/421; 84/327; 224/910

(58) Field of Classification Search ..... 84/421, 84/327; 224/910
See application file for complete search history.

(56) References Cited

U.S. PATENT DOCUMENTS

| | | | | | |
|---|---|---|---|---|---|
| 725,069 | A | * | 4/1903 | Gill | 224/190 |
| 903,682 | A | * | 11/1908 | Cumpston | 224/190 |
| 1,810,519 | A | * | 6/1931 | Gerhart | 84/327 |
| 2,008,201 | A | * | 7/1935 | Chute | 224/262 |
| 2,123,676 | A | | 7/1938 | La Flame | |
| 2,484,383 | A | * | 10/1949 | Lee | 224/185 |
| 2,973,030 | A | * | 2/1961 | Matthewson | 297/393 |
| 3,120,332 | A | * | 2/1964 | White | 224/189 |
| 3,140,800 | A | * | 7/1964 | Henderson | 222/174 |
| 3,204,650 | A | * | 9/1965 | Shinew | 135/16 |
| 3,322,312 | A | * | 5/1967 | Mitchell | 224/635 |
| 3,554,203 | A | * | 1/1971 | Hall, Sr. | 135/16 |
| 3,964,182 | A | * | 6/1976 | Pomeret et al. | 37/466 |
| 4,139,132 | A | * | 2/1979 | Fairchild, Jr. | 224/265 |
| 4,256,007 | A | * | 3/1981 | Streit | 84/421 |
| 4,387,839 | A | | 6/1983 | Dranchak | |
| 4,402,441 | A | * | 9/1983 | Jones et al. | 224/265 |
| 4,438,763 | A | * | 3/1984 | Zablen | 128/845 |
| 4,453,442 | A | * | 6/1984 | LaFlame | 84/421 |
| 4,483,070 | A | * | 11/1984 | Junkermann | 30/296.1 |
| 4,634,032 | A | * | 1/1987 | LaFlame | 224/265 |
| 4,644,654 | A | * | 2/1987 | Howe et al. | 30/296.1 |
| 4,799,610 | A | | 1/1989 | Hsieh | |
| 5,054,357 | A | | 10/1991 | Pyle | |
| 5,060,836 | A | * | 10/1991 | Bradford et al. | 224/271 |
| 5,072,910 | A | | 12/1991 | May | |
| 5,076,131 | A | * | 12/1991 | Patterson | 84/421 |
| 5,199,940 | A | * | 4/1993 | Morris et al. | 602/19 |
| 5,400,683 | A | * | 3/1995 | LaFlame | 84/421 |
| 5,464,137 | A | * | 11/1995 | Shirdavani | 224/265 |
| 5,691,492 | A | | 11/1997 | May | |
| 5,836,489 | A | * | 11/1998 | Swetish | 224/262 |

(Continued)

*Primary Examiner* — Elvin G Enad
*Assistant Examiner* — Robert W Horn

(57) ABSTRACT

The MRS NAP apparatus is disclosed for carrying marching percussion or other objects, particularly but not exclusively drums of various sizes and amalgamations and other objects carried at a person's frontal area near waist height. The apparatus is worn about the user's waist and the utility uses the person's hips to bear the instrument's load. Current state of the art places a majority of the load upon the shoulders and spine. The apparatus relieves the shoulder and spine of weight and pressure and also allows more upper body movement. The MRS NAP apparatus consists of an exoskeleton load bearing frame for a solid platform to hold the carried object stably, an endoskeleton padded for comfort, a vertical spinal column brace, and straps from the apex of the spinal column brace for stability of larger objects. The MRS NAP apparatus is adjustable for various consumers of diverse sizes.

15 Claims, 3 Drawing Sheets

U.S. PATENT DOCUMENTS

Figure 1:
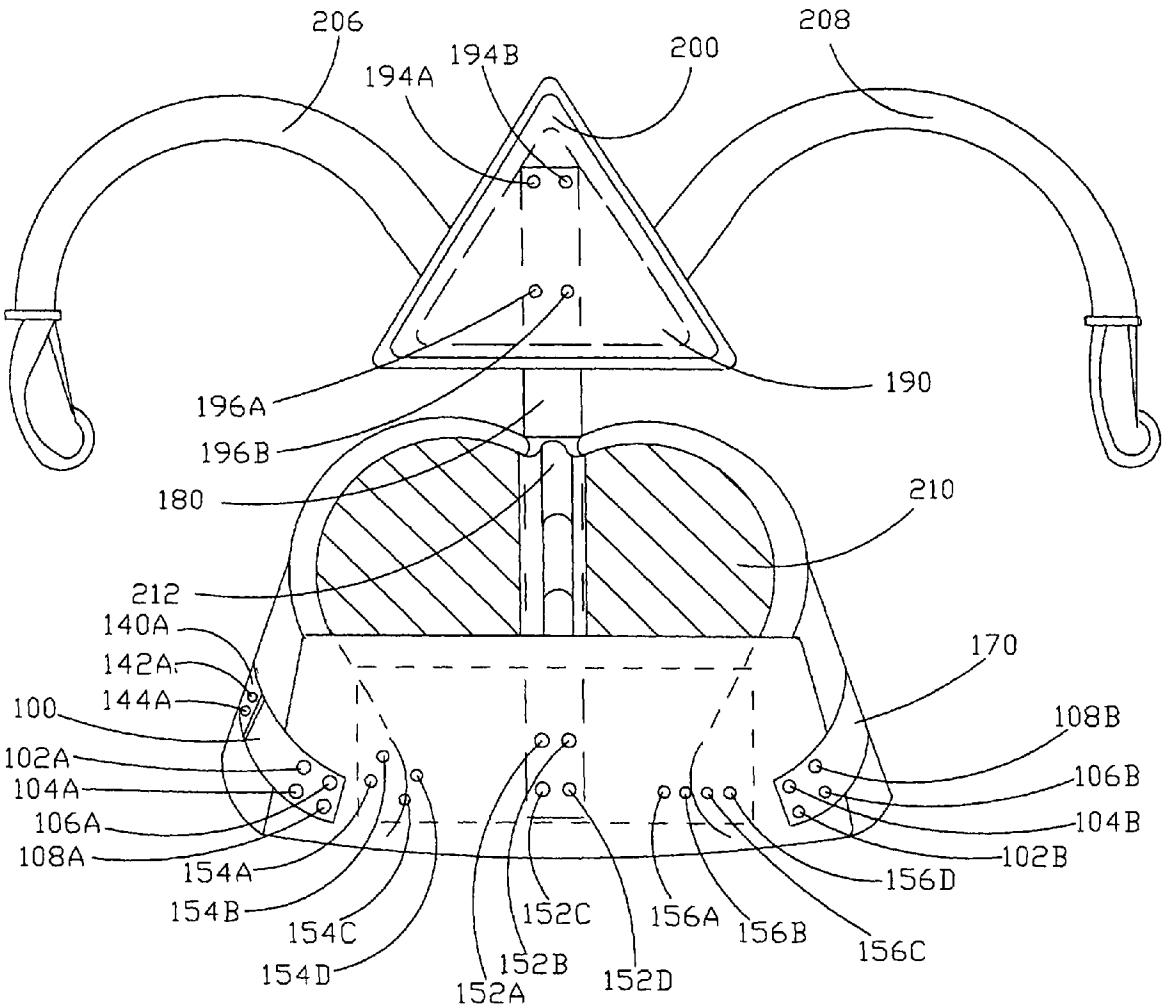

| | | | | |
|---|---|---|---|---|
| 5,887,771 | A * | 3/1999 | Perry | 224/190 |
| 5,941,436 | A * | 8/1999 | Washington et al. | 224/270 |
| 6,024,464 | A * | 2/2000 | De Vera | 362/102 |
| 6,028,257 | A | 2/2000 | May | |
| 6,155,764 | A * | 12/2000 | Russo | 414/11 |
| 6,172,290 | B1 | 1/2001 | May | |
| 6,213,363 | B1 * | 4/2001 | Norberg | 224/270 |
| 6,308,722 | B1 * | 10/2001 | Christie | 135/16 |
| 6,323,407 | B1 | 11/2001 | May | |
| 6,329,583 | B1 | 12/2001 | May | |
| 6,364,186 | B1 * | 4/2002 | Gilmour et al. | 224/637 |
| 6,450,377 | B1 * | 9/2002 | Oriolo | 224/266 |
| 6,481,108 | B1 * | 11/2002 | Helinski | 30/296.1 |
| 6,619,521 | B2 * | 9/2003 | Hadley | 224/190 |
| 6,866,173 | B2 * | 3/2005 | Haber | 224/160 |
| 6,881,886 | B2 | 4/2005 | May | |
| 7,009,097 | B1 * | 3/2006 | Terplivetz | 84/327 |
| 7,071,401 | B2 | 7/2006 | May | |
| 7,166,790 | B2 | 1/2007 | May | |
| 7,394,008 | B2 | 7/2008 | May | |
| 7,420,110 | B2 | 9/2008 | May | |
| 7,554,024 | B2 * | 6/2009 | Miyajima | 84/421 |
| 7,671,261 | B1 * | 3/2010 | Momose | 84/421 |
| 7,709,714 | B2 * | 5/2010 | Harbaugh et al. | 84/327 |
| 2007/0090143 | A1 * | 4/2007 | Clayton et al. | 224/637 |
| 2011/0162509 | A1 * | 7/2011 | Place et al. | 84/421 |

* cited by examiner

APPARATUS FOR USING A PERSON'S HIPS TO CARRY THE LOAD OF MARCHING PERCUSSION EQUIPMENT OR OTHER OBJECTS WHICH ARE CARRIED NEAR WAIST-HEIGHT AND IN FRONT OF A PERSON

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISC APPENDIX

Not Applicable

BACKGROUND OF THE APPARATUS

1. Field of the Apparatus

The apparatus relates to new and useful improvements in apparatus for carrying marching percussion and other instruments, particularly drums of various kinds. Further, the apparatus relates to a carrier hardware including a novel support for percussion and other instruments and to carrier assemblies supporting percussion and other instruments on a person while standing, walking or marching. Further, the apparatus relates to a carrier hardware that can be employed to carry any object in the front of a person near waist height. In particular, the apparatus relates to a combination of a carrier assembly with a shift of weight and force vectors to the hips from the existing state of the art weight and force vectors on the shoulders and spinal column.

2. Brief Description of the Prior Art

The prior art discloses many examples of apparatus for supporting percussion instruments but none providing the combination of features disclosed and proclaimed herein.

La Flame U.S. Pat. No. 5,400,683 discloses a carrier for percussion instruments having an abdominal plate connected at one end of a unitary frame partly encircling the consumer at the waist and having an upstanding rear portion pivotally connected to a back pressure plate. Shoulder bars are connected to the back-pressure plate and wrap about shoulders and support straps connect to the abdominal plate, creating weight and force vectors on the spine.

Hsieh U.S. Pat. No. 4,799,610 shows a carrier for percussion instruments having a "T" bar, a pair of shoulder bars, and a belly plate. The shoulder bars are bolted on a lateral plate of the "T" bar. The lateral plate has arc-like slots and spaced semi-circular holes permit bolts to slide in the slots.

The fastening end of each shoulder bar has a hole and an arc-like slot from the upper portion to the lower portion permitting angular adjustment of the shoulder rightward or leftward for various applications. This patented state of the art puts weight and force vectors on the spine. Further, depending on the specific design, the breast plate design discourages female percussionists from participation in drum lines due to pressure on the breast caused by the carrier.

La Flame GB patent 2,123,676 (based on U.S. Pat. No. 4,453,442) discloses a carrier for percussion instruments or the like which includes the combination of a belly plate with a carrier bracket for supporting an instrument at an outwardly-overhung position about a fulcrum area of contact with the front waistline area of the person, a rigid band with a generally bent contour to extend along a portion of the waistline area of the person to the back of the person, a back-plate riser arm supported by the band to extend in a generally upward direction such that a portion of the arm will extend along the back thoracic region of the person, and means carried by the arm for imparting to the thoracic back region of the person a reactive force to the overhung weight of the instrument about the aforesaid means forming a fulcrum area of contact with the person. This has the weight and motion of the musical instrument directly on the shoulders and spinal cord of the consumer.

Dranchak U.S. Pat. No. 4,387,839 discloses a drum-supporting harness having two shoulder-hooks with cushion pads or liners, a breastplate secured to the hooks, and a hanger structure attached to the breast plate and depending there from. Upwardly-facing hooks, a spacer bar extending downward from the hooks, and a spacing abutment carried by the spacer bar and extending forward there from, are carried by the lower portion of the hanger structure. The hooks and the spacing abutment engage upper and lower portions of the body of the drum. The hanger structure is adjustable or extensible by means of overlapping strips, which can be secured in a number of different positions. An adapter assembly attaches to the upper rim portion of the drum for connecting of hooks to the drum. Similar to the state of the art articulated in the Hsieh Patent (U.S. Pat. No. 4,799,610), depending on the specific design, the breast plate design discourages female percussionists from participation in drum lines due to pressure on the breast caused by the carrier.

Other possibly relevant prior art is Pyle U.S. Pat. No. 5,054,357; May U.S. Pat. No. 5,072,910; May U.S. Pat. No. 7,420,110; May U.S. Pat. No. 7,394,008; May U.S. Pat. No. 7,166,790; May U.S. Pat. No. 7,071,401; May U.S. Pat. No. 6,881,886; May U.S. Pat. No. 6,329,583; May U.S. Pat. No. 6,323,407; May U.S. Pat. No. 6,172,290; May U.S. Pat. No. 6,028,257; May U.S. Pat. No. 5,691,492.

BRIEF SUMMARY OF THE APPARATUS

One object of the MRS NAP apparatus is to provide a new and improved carrier for percussion, other instruments and objects carried in front of a person comprising a method for the weight, force, and motion vectors of the carried percussion or other object to be focused on the lower torso and hips of the percussionist or other consumer rather than the existing art apparatuses with weight, force, and motion vectors of the carried percussion or other instruments focused on the shoulders and spinal column of the percussionist or other consumer.

Another object of the MRS NAP apparatus is to provide a new and improved carrier for percussion or other instruments incorporating the adjustable spinal column brace to allow the percussionist's or other consumer's spinal column a more natural and healthier position.

Another object of the MRS NAP apparatus is to allow the inclusion of more female percussionists in the marching drum ensemble. The present state of the art breastplate-type carriers discourages female percussionists from participating in the marching drum ensemble because of painful pressure on female breasts. Without the breastplate apparatus, more females will be able to join the marching drum ensemble.

In prototype field tests, the percussionists reported no pressure upon the shoulders, no spinal stress and much more upper torso freedom of movement with the MRS NAP apparatus. These reports show a better tolerance for the human body to accept the weight, force, and motion vectors with the MRS NAP apparatus than the present state of the art. The creators of the MRS NAP apparatus believe that this apparatus will change the present marching drum ensemble capabilities. The field test was not a scientific examination of the apparatus.

The actual production realization of the MRS NAP apparatus could alter with advanced production techniques. These alterations would not modify the claim of removing the weight and motion of the instruments or other objects carried by the consumer from the present state of the art of shoulders and spinal chord to the hips and lower torso (see claim).

Other objects of the MRS NAP apparatus will become apparent throughout the specification and claims as hereinafter related.

BRIEF DESCRIPTION OF THE SEVERAL VIEWS OF DRAWINGS

Figure 2:
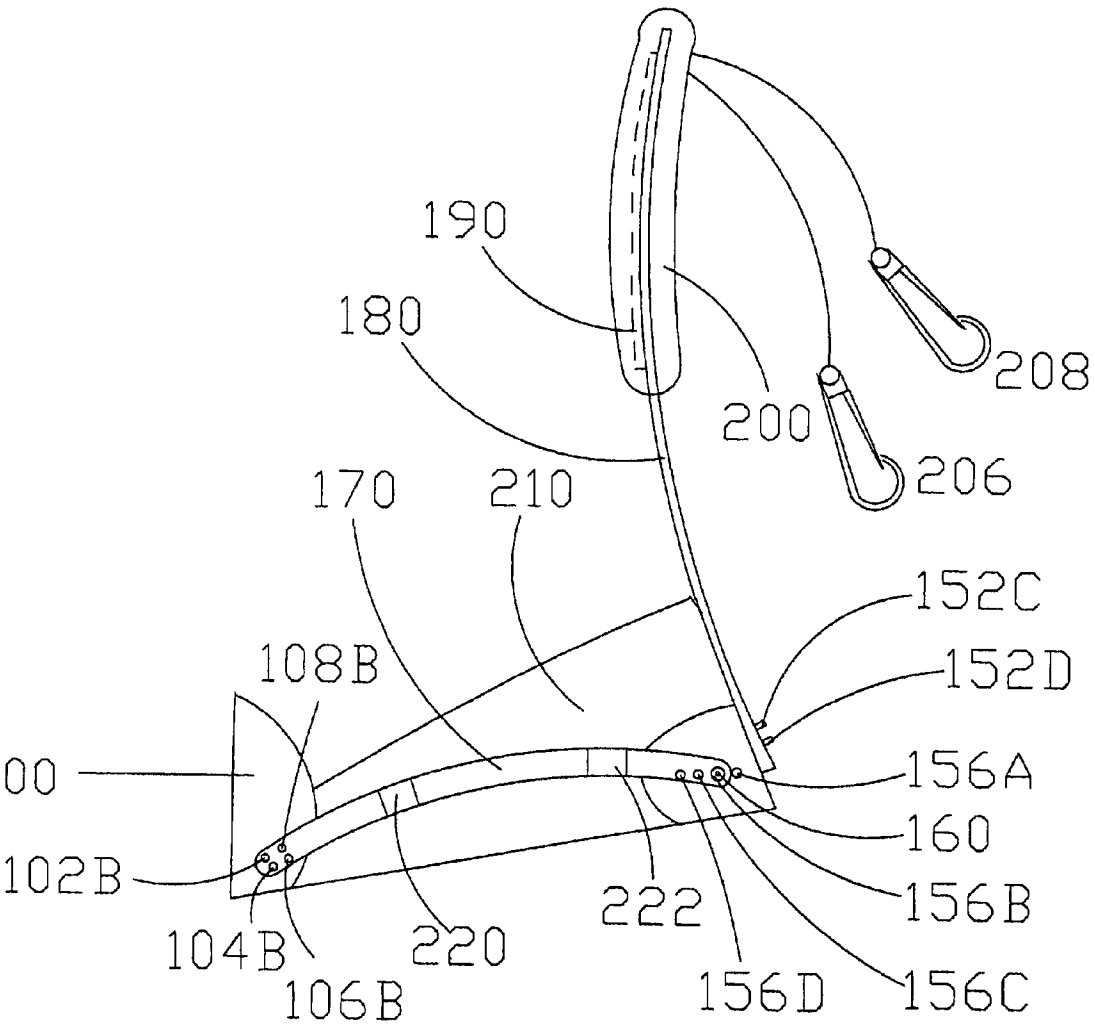
Figure 3:
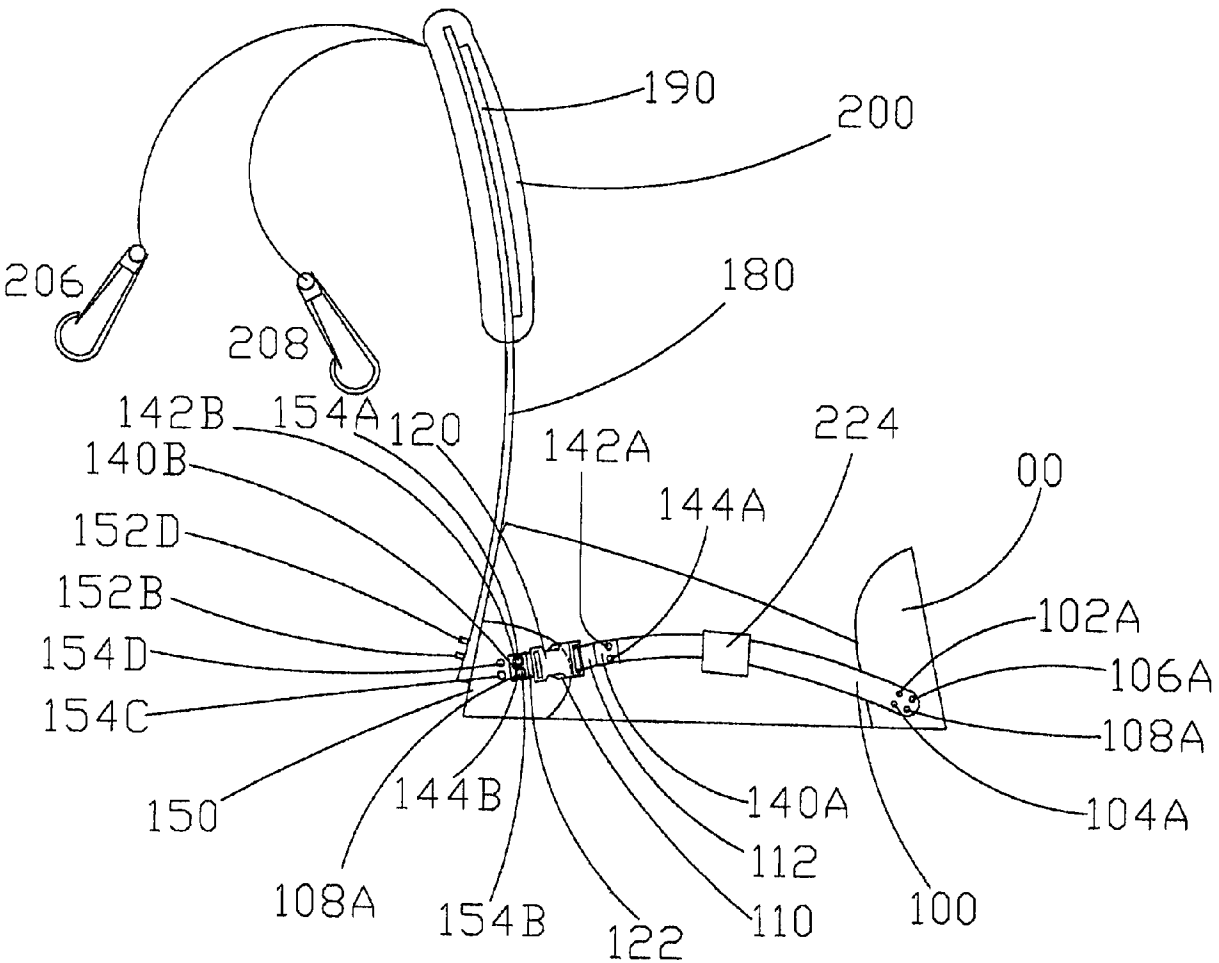

FIG. 1 Frontal View of the apparatus
FIG. 2 Left Side View of the apparatus
FIG. 3 Right Side View of the apparatus

DETAILED DESCRIPTION OF THE PREFERRED EMBODIMENTS

As shown in FIGS. 1, 2, and 3, the apparatus consists of a front member 00 connected to the side members 100 and 170 by a secure and rigid connection. Side members 100 and 170 are of a material, thickness, and convex curves away from the wearer to allow stability of the exoskeleton and have the flexibility necessary for this apparatus to function as designed. These side members 100 and 170 are connected to the back plate member 150 by a secure but not rigid connection. This is accomplished on the left side by a bolt and locking nut 160. This approximate ⅜ inch gap between the side members 100 and 170 and the back member 150 is necessary for this apparatus to function as designed. The right side member is attached to the back plate member by a snap connector providing similar flexibility plus a way for the consumer's ingress and egress to the apparatus. Spinal brace 180 rises from the center of the back member. The Front Plate Member must be on a plane lower than the Back Plate Member. This allows for required positioning of the carried object and the proper support for the carrying person. The endoskeleton 210 is a tapered padded material for the wearer's comfort. The endoskeleton is tapered to accommodate the wearer and the requirements of the exoskeleton. The endoskeleton and spinal brace pad 200 are easily removable for washing.

The Front Member (00) is the member of the Apparatus where percussion or other instruments are attached to the Apparatus and must be of a material to allow nominal flexing.

The Front Member (00) is attached to the side members with a rigid connection at an angle that allows the front plate to be on a plane lower than the back plate.

The Right Hip Member (100) consists of a metal or other material member approximately 10" long by approximately 1.5" wide that is curved in a single plane at an approximate upward 45° curve. The Right Hip Member (100) attaches to the front plate member (00) at the bottom right hand side with a secure and rigid connection of at least two points to maintain the upward curve. The member's initial contact point of approximate 45° angle must be maintained to ensure the front plate member is held at a perpendicular plane to the percussionist or other consumer. (comparison U.S. Pat. No. 5,060,836—prior patent had no angle but assumed static tension front to back). The member attaches to back plate member (150) by snap connector or other fastener (110 & 120). The tensile strength and thickness should allow for flexing of the metal or other material strip of the right hip member but hold its general curved angle.

A snap connection consists of a plastic or other material male (110) and female (120) connection or other connector attached to the adjustable webbing strap or other material (112 & 122). The webbing or other connector is approximately 17" long on the male side (112) and 13" long on the female side (122), using approximately 4" each to hold it in place and approximately 13" and 9", respectively, available for adjustment on the member. The male portion of the snap connection or other connector is attached to right hip plate member via a pressure plate over the end of the web strap member (114). Attachment to the right hip plate member is in the same plane as the hip plate member as if it were an extension of the hip plate member. The female portion of the snap connection member or other connector is attached to the bottom edge of the right side of the back plate member at an approximate 45° angle via a pressure plate over the end of the web strap member (122).

Both the male and female portion of the snap connection or other connector is adjustable on the webbing or other material member allowing for custom sizing to the percussionist consumer and for easier entrance and egress (116). At the consumer entrance, the loose male connector or other connector member would attach to the female connector or other connector member and then the percussionist consumer would adjust the webbing strap or other adjustment member to sufficient tightness to ensure proper function of the hip strap member.

The back plate member (150) has an approximate curve of 45° to fit around the consumer's back and is approximately 14" long and approximately 4" wide. It consists of metal or other material to allow nominal flexing end to end and nominal torque from side to side. The right side has at least two holes to attach the pressure plate member for the female snap connector or other connector member (152). To attach the back brace member (154), the center of the back plate member has at least four holes; two on each side of a center line approximately ½" from the center and approximately two inches apart from top to bottom; beginning approximately ½" from the bottom of the plate member. The left side of the back plate member has several horizontal holes for purposes of attaching the left hip plate member to the back plate member. The different horizontal holes allow for adjusting the overall size of the apparatus to fit different consumers. The holes are of sufficient size to accommodate a quarter inch bolt or similar pivot apparatus (156).

The pivot apparatus member (160) is used to attach the left hip plate member (170) to the back plate member. The member consists of a bolt and nut type apparatus or other connector (162 & 164) that goes through the left hip plate member and back plate member fitting them tight enough to press the two plate members together, and loose enough to allow some pivot action between the back and left hip plate members.

The Left Hip Member (170) attaches to the front plate member at the bottom left hand side with a secure and rigid connection. The member's initial contact point of approximate 45° angle must be maintained to ensure the front plate member is held at a perpendicular plane to the percussionist or other consumer. The Left Hip Member attaches to the front plate member (00) at the bottom left hand side with a secure and rigid connection of at least two points to maintain the upward curve. It is made of a metal or other material strip member approximately 15" long by approximately 1.5" wide curved in a single plane to an approximate 90° curve. Its purpose is to hold the front plate member in proper position and attaches the front plate member to the remainder of the hip strap member. The member attaches to back plate member by way of pivot apparatus member (160). The tensile strength and thickness should allow for allow for flexing of the metal or other material strip of the right hip member but hold its general curve angle.

The Spinal Column Brace Member (180) consists of a metal or other material strip member approximately 14" long by approximately 1.5" wide mounted vertically from the center of the back plate member (150) using the four holes in the center of the back plate member (extending approximately 10" above the top of the back plate member). The spinal column brace member base has four holes that align with the four holes in the back plate member allowing the spinal column brace member to extend from the base of the back plate member. The member attaches by small nuts and bolts or other fasteners. The spinal column brace member has a 5° angle to conform to the curvature of the human spine. This angle is adjustable to conform to different spinal curvatures.

A triangle shaped Spinal Column Brace Pinnacle Member (190) attaches to the spinal column brace at approximately 8" from the bottom of the spinal column brace member. The member is an equilateral triangle or similar shape made of metal or other material approximately 4", centered on the spinal column brace, beginning at approximately 8" from the base of the back plate member. It is held to spinal cord brace member with small four small bolts and nuts or other fasteners (194, 196).

The Spinal Column Brace Zenith Triangle Padding Member (200) consists of a thick pad toward the consumer wearer held in place by Velcro or other material straps or molded around the Spinal Column Pinnacle Member (190). Optional shoulder strap members may be attached to the spinal column brace zenith padding member for larger percussion instrument stability (206, 208). If the strap configuration is used, the weight transferred to the shoulders is incidental and minimum.

The Endoskeleton of the apparatus consists of a Padded Hip Belt Member (210) on the inside of the four plate members used to cushion the percussionist from the metal or other material plates of the exoskeleton. The function of the member is to act as a hip strap to support the weight of the plate members and the percussion instrument attached on the front plate. The member is made of material such as a rip-stop nylon or other material covering a polyurethane or other material type pad. The padded hip belt member is removable for cleaning. The padded hip belt member height is approximately 7.5" at the back plate member tapering to approximately 5" at the front plate member. The middle section of the rear of the belt is an approximately 6" wide non-padded section that will allow for multiple size adjustments (212).

The padded hip belt member attaches to the plate members using straps of other connectors circling the plate members at various locations. The straps or other connectors will use Velcro or other materials to attach the endoskeleton to the exoskeleton. The left and right plate members will require one to two straps to hold the padded hip belt member in place (220,222, 224). The back place member will require two or more connectors placed on either side of the back plate member connections.

The invention claimed is:

1. A load bearing apparatus worn about the hip for carrying percussion instrument or other objects to support the weight and force vectors near the frontal area of a human body using a front plate member at approximately hip height, comprising:

an external frame and an internal padding element:

the external frame comprising:

a rigid, front plate member worn in a low position on the front of the hip, the plate further comprising fastener holes for carrying a percussion instrument or other carried object;

a rigid, rear plate member worn in a position on the upper, rear of the hip, side members that interconnect the front and rear plates and press the front and rear plates into engagement about the front and rear of the hips, wherein a lower edge of the front plate member is on a lower plane than a lower edge of the rear plate member, and wherein the external frame is placed over the internal padding element, the two cooperating to securely bear a load on the hips.

2. The load bearing apparatus of claim 1, where the side members further comprises left and right side members that slant downward front rear to front, oriented at approximately 45° with respect to the front plate.

3. The load bearing apparatus of claim 1, where the left and right side members are curved bands, that are narrow with respect to the front and rear plates, and that comprise an opening for ingress and the external frame flexibly expands to a wider curve as it is being attached and fitted to the user.

4. The load bearing apparatus of claim 3, where the band with the opening is fastened about the user after the apparatus is fitted into position on the hips of the user over the padding element.

5. The load bearing apparatus of claim 1, where the rear plate support member connects to a beam contoured to the spine of the user extending up the user's back to a brace that presses about the center of the user's back.

6. The load bearing apparatus of claim 5, where the beam comprises padding toward the back of the user.

7. The load bearing apparatus of claim 5, where the beam at its distal end has a triangular plate backed by padding.

8. The load bearing apparatus of claim 4, where the band at the opening side comprises a strap with two strap portions, a snap-release fitting with male and female components, and a tension adjuster allowing the apparatus to be opened while being put on the user and to be adjusted.

9. The load bearing apparatus of claim 7, where the triangular plate further comprises shoulder straps for stringing over the user's shoulders to an attachment area of an instrument.

10. The load bearing device of claim 9, where the shoulder straps comprise releasable hooks at the end of the straps for releasably fastening to an attachment area on a supported instrument.

11. The load bearing device of claim 3, where the left and right bands are curved to a user's contour for snug fitting to the internal padding element.

12. The load bearing device of claim 1, where the internal padding element comprising a wide, padded hip belt wrapped around the hip, the belt being substantially wider than the external frame side elements.

13. The load bearing device of claim 12, where the hip belt tapers to a narrower width from rear to front.

14. The load bearing device of claim 12, where the hip belt comprises a non-padded section at the rear, middle section to allow for multiple size adjustments.

15. The load bearing device of claim 12, where the hip belt comprises multiple fastening elements for fastening the external frame to the belt.

* * * * *